US006981452B2

(12) United States Patent
Herzog et al.

(10) Patent No.: US 6,981,452 B2
(45) Date of Patent: Jan. 3, 2006

(54) METHOD AND APPARATUS FOR UNLOADING RIBBON RAILS FROM RAIL CARS

(75) Inventors: Stanley M. Herzog, St. Joseph, MO (US); Ivan E. Bounds, Lake Havasu City, AZ (US); Timothy M. Beers, Turney, MO (US); Wayne Lee Gladden, Wathena, KS (US); Lawrence E. Guerra, Shawnee, KS (US)

(73) Assignee: Herzog Contracting Corp., St. Joseph, MO (US)

( * ) Notice: Subject to any disclaimer, the term of this patent is extended or adjusted under 35 U.S.C. 154(b) by 0 days.

(21) Appl. No.: 10/773,577

(22) Filed: Feb. 6, 2004

(65) Prior Publication Data

US 2005/0172849 A1 Aug. 11, 2005

(51) Int. Cl.
*B65G 13/00* (2006.01)

(52) U.S. Cl. ..... 104/2; 414/338; 414/339; 414/529

(58) Field of Classification Search ..... 104/2, 104/5, 15; 414/339, 745.4, 745.5, 746.7, 414/529, 486, 338, 501, 679

See application file for complete search history.

(56) References Cited

U.S. PATENT DOCUMENTS

| | | | | |
|---|---|---|---|---|
| 3,557,703 | A * | 1/1971 | Moorefield et al. | 104/2 |
| 4,917,020 | A | 4/1990 | Wicks et al. | |
| 5,222,435 | A | 6/1993 | Theurer et al. | |
| 5,289,780 | A | 3/1994 | Bounds | |
| 5,520,497 | A | 5/1996 | Hertelendi et al. | |
| 5,630,365 | A | 5/1997 | Hertelendi | |
| 5,762,464 | A | 6/1998 | Hertelendi | |
| 5,961,271 | A * | 10/1999 | Theurer et al. | 414/339 |

* cited by examiner

*Primary Examiner*—Mark Tuan Le
(74) *Attorney, Agent, or Firm*—Blackwell Sanders Peper Martin LLP

(57) ABSTRACT

A method and apparatus for unloading long ribbon rails which are carried on a transport car on bunks which hold the rails in four or five different tiers each containing eight to ten rails. A special railcar is equipped with a gantry crane which feeds the rails from the bunks into power driven thread boxes. The thread boxes grip the rails and feed them rearwardly onto the railway bed. After the first two rails have been unloaded side by side, the next pair are fed into the thread boxes. The thread boxes feed these rails out of the bunks as the train is moved forwardly at the same speed as the rails are fed rearwardly so that the rails are unloaded end to end with the first pair of rails. The railcar has retractable over the road wheels that allow it to be towed on the roadway to the site of the rail transport car.

4 Claims, 4 Drawing Sheets

METHOD AND APPARATUS FOR UNLOADING RIBBON RAILS FROM RAIL CARS

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

This invention relates generally to railroad equipment and more particularly to a method and apparatus for unloading long rails that are commonly referred to in the industry as ribbon rails.

BACKGROUND OF THE INVENTION

In the railroad industry, one of the more difficult and labor intensive operations is the laying of track, either in new railway construction or in the replacement of worn or damaged existing rails. It is an industry standard for rails to be manufactured in sections that are each 39 feet long. In order the maximize quality control and minimize costs, the sections are often welded together end to end at a steel mill to form longer sections that are commonly known as ribbon rails. These ribbon rails can be any length up to 1800 feet long or even longer.

Ribbon rails are transported to the area along the railway where they are to be installed by loading them onto rail cars that are equipped with special bunks on which the ribbon rails are carried side by side. There are typically a number of tiers provided on the bunks with each tier holding eight to ten rails spaced apart transversely. Due to their extensive lengths, the ribbon rails span the bunks on a number of different rail cars which are driven by a locomotive along the track to the area where the rails are to be installed.

Conventional practice for unloading the ribbon rails on each side has involved the use of a winch. A winch cable is extended from the winch drum by hand and passed manually through a number of thread boxes and around pulleys and sheaves and is then connected to the end of the first rail that is to be unloaded. The winch is operated to pull the rail off of the back end of the rear rail car and onto the railway bed. The end of the first rail is then anchored to the ground. The rail that is beside the first rail is then pulled off by the winch until its end can be anchored to the ground beside the first rail. The train is driven forwardly at this point to unload the first two rails.

Next, the second pair of rails are winched off until their back ends can be connected to the front ends of the first pair of rails by rigid tie bars. As the train is moved forwardly again, the second pair of rails is unloaded and is situated end to end with the rails in the first pair. The remaining rails are thereafter unloaded successively in this fashion.

As can easily be appreciated, this procedure requires a considerable amount of manual labor. Workers must thread the winch cable through the boxes and the sheave system repeatedly and manually connect and disconnect the cable and the tie bars. The workers also have to cover great distances to detach the tie bars each time a pair of rails has been unloaded. Perhaps even more disadvantageous than the labor costs is the risk of serious injury that is encountered due to the need for extensive manual handling of the rails, the winch cable, the tie bars and other associated equipment.

U.S. Pat. No. 5,762,464 to Hertilendi discloses railway equipment using a crane and guide rollers through which rails can be fed to load them from a ditch onto a rail car. The guide rollers do not provide power assistance for either loading or unloading of rails, and the crane is used to perform essentially the same work as the winch which is used in the conventional unloading procedure previously described. Consequently, if this type of equipment is used in the unloading of rails, the rails still have to be tied end to end manually using tie bars, and the high labor costs and the high risk of personal injury remain serious problems.

SUMMARY OF THE INVENTION

The present invention is directed to an improved apparatus for unloading ribbon rails and also to an improved method by which the ribbon rails can be unloaded with reduced labor requirements and reduced danger of personal injury.

In accordance with the invention, the ribbon rails are unloaded in succession by feeding the first rail into one or more power driven thread boxes which can be operated to pull the rail off of the back end of the rail car that carries the rails. Once a pair of rails has been unloaded in this fashion side by side, two more rails may be fed into the thread boxes. The train can be driven forwardly while the thread boxes are operated to feed the rails rearwardly at substantially the same speed as the train moves forwardly. As a result, the second set of rails is unloaded onto the railway bed in an end to end relationship to the first set of rails. Succeeding rails are unloaded in pairs in the same way.

Apparatus which may preferably be used to carry out the rail unloading operation includes a specially constructed rail car having a rigid frame that is equipped with flanged rail wheels for travel on the railway track. The special unloading car can be coupled to the rearmost of the cars that carry the ribbon rails. One to three power driven thread boxes on each side of the unloading rail car may be arranged one behind the other and equipped with rollers for receiving the rails and a drive system for feeding the rails through each thread box and onto the railway bed. A gantry crane on the unloading car moves along tracks on the car and is equipped with a boom having a claw or other gripping device for feeding the rails one at a time into the thread boxes.

A particular feature of the preferred rail unloading car is the provision of roadway wheels on the rear which allow it to be towed along a roadway by a suitable towing vehicle to the site where it is to be used. The unloading car can be towed to the railroad track and the roadway wheels can be pivoted upwardly to lower the flanged rail wheels onto the rail. The front end of the unloading car can be unhitched from the towing vehicle such that the front flanged wheels are likewise located on the track to allow the unloading car to be coupled to the rear rail carrying car.

The present invention is advantageous in a number of respects, perhaps most notably because it creates substantial labor and cost savings and minimizes injury risk. There is no need to thread and connect and disconnect a winch cable and no need to attach and detach tie bars between successive ribbon rails. Additionally, the entire unloading process can be carried out more quickly than with prior equipment. Only two workers are required, one to operate the gantry crane and another to operate the thread boxes, and both are in a safe environment in cabs.

Other objects and advantages of this invention will become apparent from the following description taken in relation to the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 3:
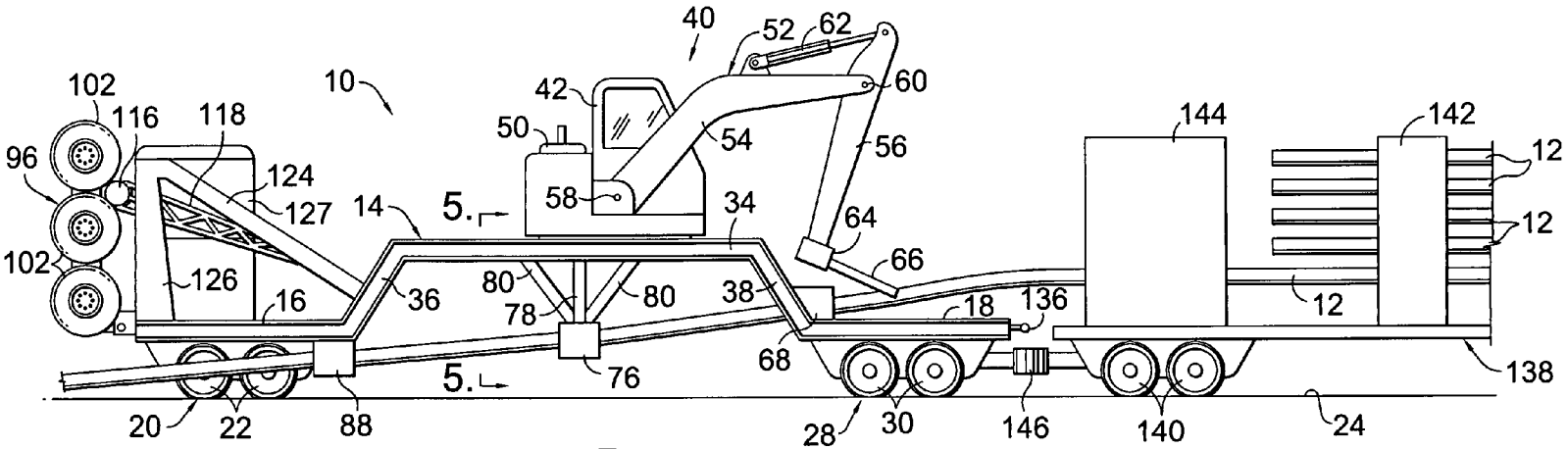
FIG. 3 is a side elevational view showing the unloading car of FIGS. 1 and 2 positioned on a railroad track and coupled to a rail car carrying ribbon rails, with the roadway wheels retracted to their storage position.

Referring now the drawings in more detail, numeral 10 generally designates a specially constructed rail car which is used for the unloading of elongated ties such as the ribbon ties 12 which are shown in FIG. 3 and which are formed by welding rail sections together end to end. The ribbon ties 12 may each have a length up to 1800 feet or more.

The rail car 10 has a rigid frame which is generally designated by numeral 14 and which includes on its back end a generally horizontal platform 16 and on its front end a generally horizontal platform 18. The rear platform 16 is equipped with a pair of flanged wheel assemblies 20 each of which includes a pair of flanged wheels 22 for application to a railroad track 24. The wheels 22 on opposite sides of the frame are mounted on axles 26. The front platform 18 is similarly mounted on a pair of front wheel assemblies 28 each including a pair of flanged wheels 30. The wheels 30 on opposite sides of the frame are mounted on axles 32. The wheels 22 and 30 allow the car 10 to travel on the railroad track 24.

The frame 14 includes a pair of elevated horizontal beams 34 which connect at their back ends with inclined beam sections 36. The beam sections 36 extend upwardly at an angle from the front edge of the rear platform 16. Extending from the front ends of the horizontal beams 34 are front inclined beam sections 38 which incline downwardly from the beams 34 to connection with the back edge of the front platform 18. The beams 34 are spaced apart and parallel to one another at a location elevated above the platforms 16 and 18. The beam sections 36 are spaced apart and parallel to one another, as are the front beam sections 38. The beams 34 and beam sections 36 and 38 may take the form of I beams.

Figure 5:
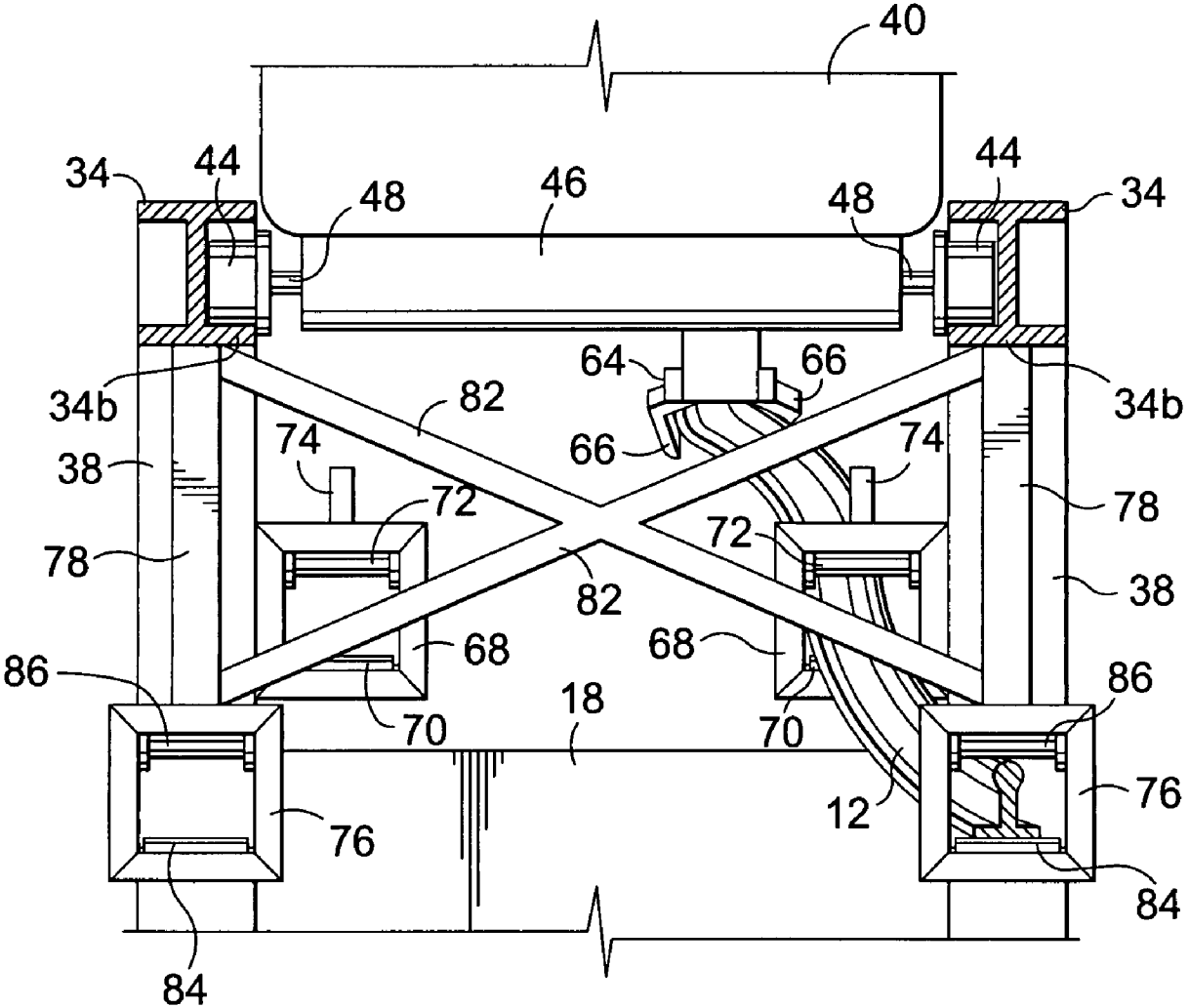
FIG. 5 is a fragmentary sectional view on an enlarged scale taken generally along line 5—5 of FIG. 3 in the direction of the arrows.

A gantry crane generally identified by numeral 40 is mounted for movement along the beams 34. The gantry crane 40 includes an operator's cab 42 in which an operator of the gantry crane 40 may be stationed. As best shown in FIG. 5, the under side of the gantry crane 40 is provided with four flanged wheels 44 (two of which are shown in FIG. 5). Two of the wheels 44 may be idler wheels while the other two of the wheels 44 may be driven by a transmission 46 having output shafts 48. The transmission 46 is driven by an engine 50 (FIG. 3). The wheels 44 ride along the lower flanges 34*b* (FIG. 5) of the beams 34 to allow the gantry crane 40 to travel along the lengths of the beams 34 in a direction parallel to the underlying railroad track 24.

The gantry crane 40 is equipped with an elongated boom which is generally identified by numeral 52. The boom 52 has a base boom section 54 and an outer boom arm 56. The boom 52 can be rotated about a vertical axis located at the inboard end of the base boom section 54. The base boom section 54 can be raised and lowered about a horizontal axis 58. The boom arm 56 is pivotally connected at 60 with the outer end of the base boom section 54 and may be pivoted up and down about the horizontal axis provided by the pivot connection 60. A hydraulic cylinder 62 may be used to pivot the boom arm 56 up and down relative to the base boom section 54. The outer end of the boom arm 56 is equipped with a gripping device which may take the form of a claw 64 having a pair of pivot jaws 66 that can be opened and closed to grip onto the ribbon rails 12 and release from the rails.

The rail car frame 14 is provided with a pair of front thread boxes 68 which may be mounted on top of the front platform 18 at locations spaced apart from one another adjacent to the inside edges of the front beam sections 38. The thread boxes 68 are power driven units that receive the ribbon rails 12 and feed the rails rearwardly through the thread boxes 68. As best shown in FIG. 5, each thread box 68 is open from front to rear and is equipped with a bottom roller 70 that may be an idler roller. An upper roller 72 is spaced above the lower roller 70 of each thread box 68. A motor 74 for each of the thread boxes 68 may be used to drive the roller 72 in a manner to grip the rails 12 between the rollers 70 and 72 and feed the rails rearwardly upon rotation of the upper rollers 72 by the motors 74.

An intermediate pair of thread boxes 76 are mounted on the frame 14 at locations that may be directly below the beams 34. The thread boxes 76 may be secured to the lower ends of hanger bars 78 that extend downwardly from the beams 34 near the centers of the beams. The pair of inclined braces 80 are provided for each thread box 76 with the braces 80 extending downwardly from the bottoms of the beams 34 and connecting with the thread boxes 76 at locations adjacent to the lower ends of the hanger bars 78. Further bracing is provided by diagonal cross arms 82 which extend in a crossing pattern from the top ends of the bars 78 to connection with the top of the thread box 76 located on the opposite hanger bar 78.

As best shown in FIG. 5, the intermediate thread boxes 76 are located below and outwardly from the front thread boxes 68, as well as rearwardly of the front thread boxes. Each box 76 has a lower idler roller 84 and an upper driven roller 86 which may be powered by a suitable motor (not shown). The intermediate boxes 76 operate in the same manner as the front thread boxes 68 to help feed the ribbon rails 12 rearwardly for unloading of the rails.

Figure 2:
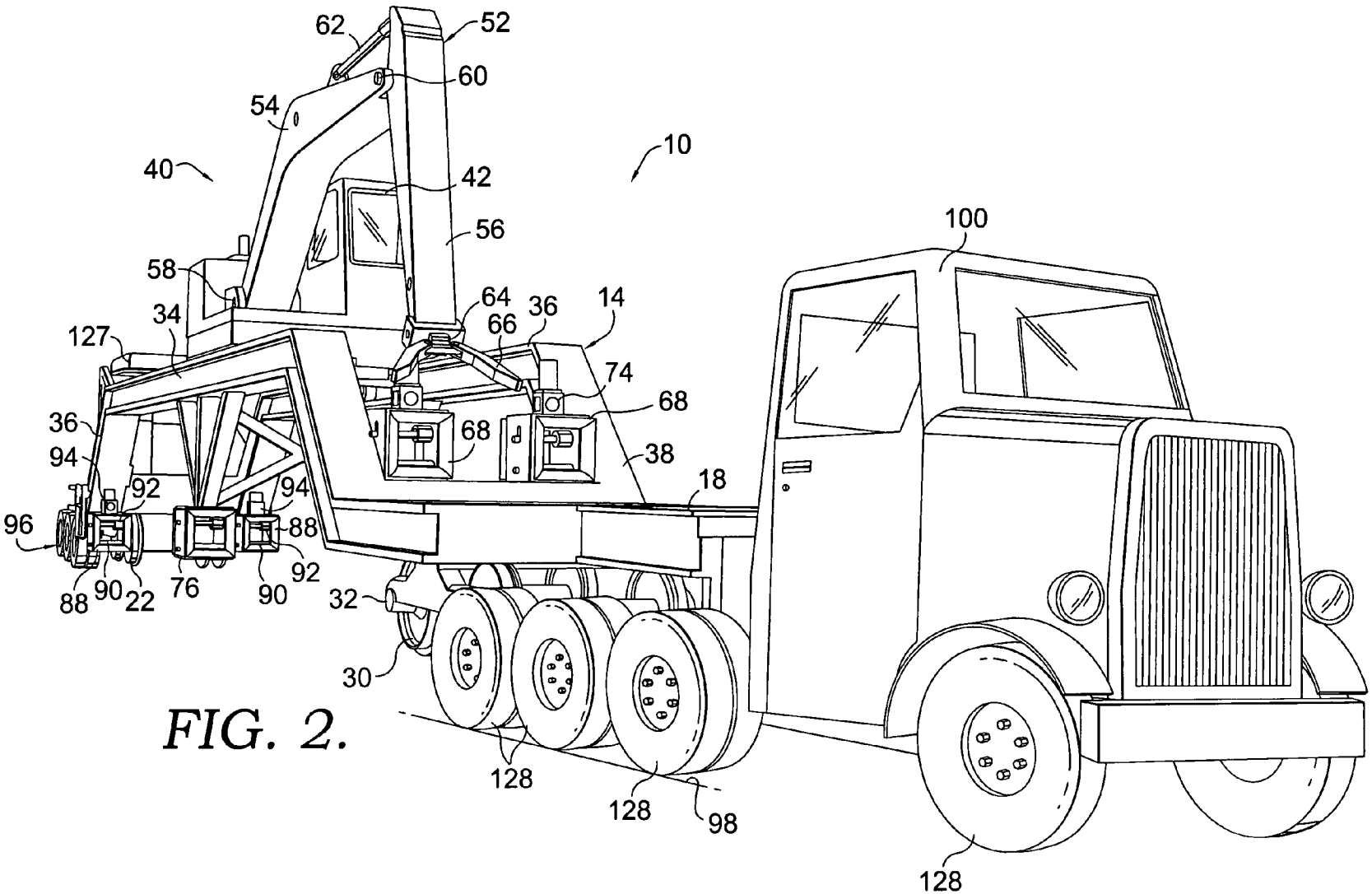
FIG. 2 is a perspective view of the unloading car shown in FIG. 1 from the front.

A pair of rear thread boxes 88 are also provided on the rail car frame 14. The rear thread boxes 88 may be mounted to the underside of the rear platform 16 at locations slightly outwardly from the rear flanged wheels 22. As shown in FIG. 2, each of the rear thread boxes has a lower idler roller 90 and an upper driven roller 92 powered by a motor 94. The rear boxes 88 are located below and slightly outwardly from the intermediate thread boxes 76 as well as to the rear of the intermediate thread boxes. The rear thread boxes 88 function in the same manner as the front and intermediate boxes to feed the rails 12 to the rear.

Figure 1:
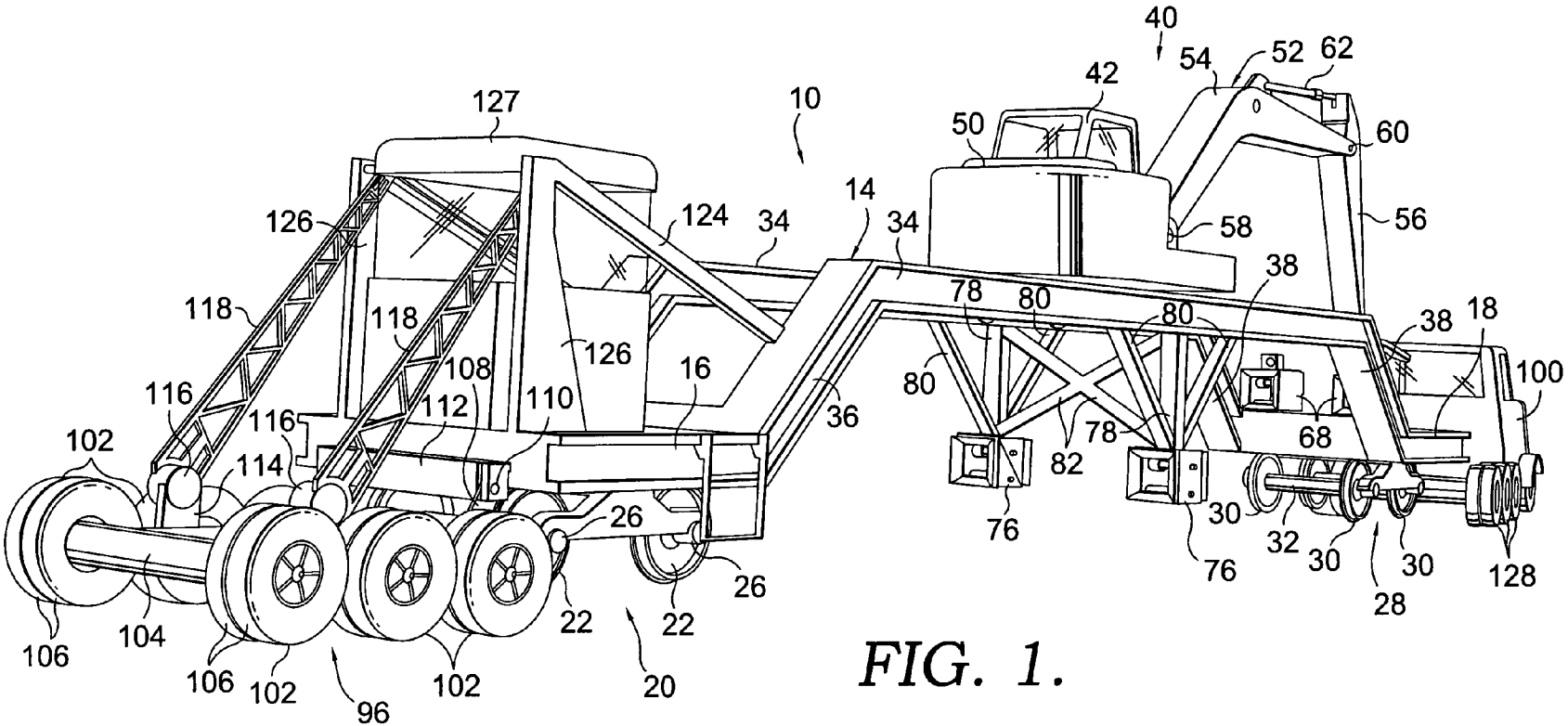
FIG. 1 is a perspective view of a specially constructed railway car that may be used for the unloading of ribbon rail in accordance with the present invention, with the unloading car being towed by a roadway vehicle and the rear roadway wheels lowered to their extended position for travel on a roadway.

The frame 14 of the rail car is provided with a retractable wheel assembly 96 which enables the rail car 10 to be towed along a highway or other roadway 98 (see FIG. 2) by a towing vehicle 100. As best shown in FIG. 1, the wheel assembly 96 includes six pair of roadway wheels 102, three pairs of the wheels 102 being located on each side. The opposing pairs of wheels 102 are connected by axles 104. Each of the wheels 102 may include a conventional pneumatic tire 106 suitable for over the road travel.

The wheel assembly 96 has a pair of arms 108 (see FIGS. 1 and 3) extending from its forward end. The ends of the arms 108 connect with a horizontal shaft 110 which may be rotated by an actuator 112. The actuator 112 may be operated to pivot the arms 108 about the axis of shaft 110 from the extended position of the wheel assembly 96 shown in broken lines in FIG. 4 and the retracted storage position shown in solid lines in FIG. 4.

Figure 4:
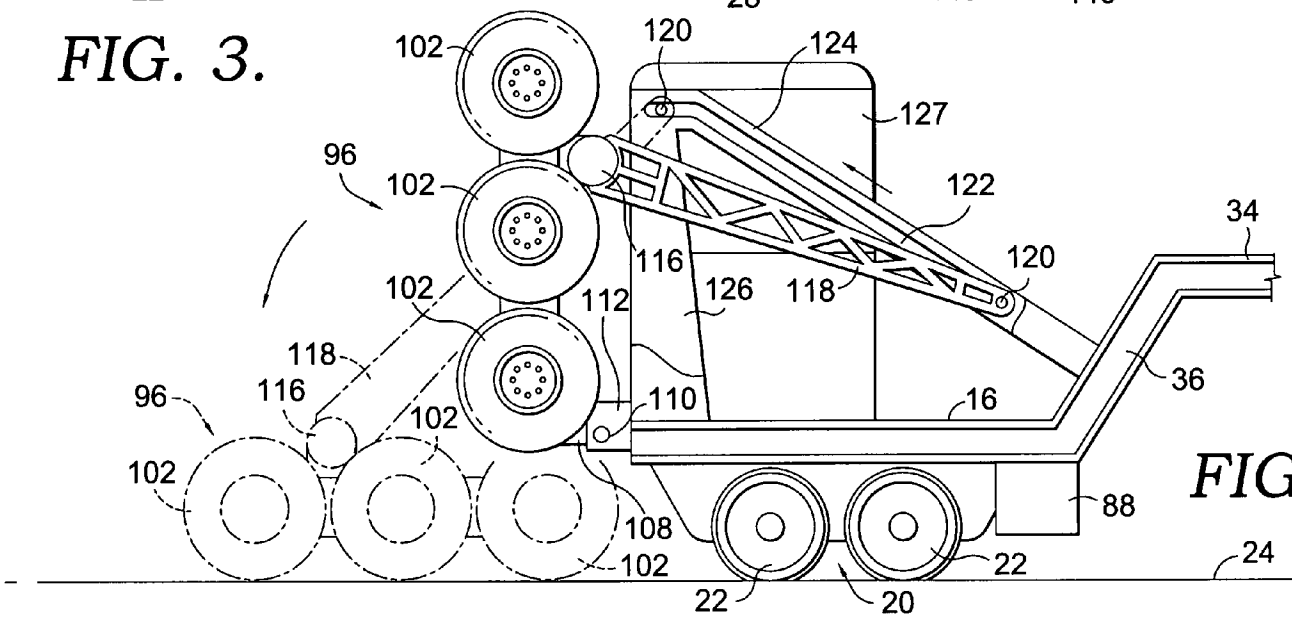
FIG. 4 is fragmentary side elevational view of the rear portion of the unloading car, with the solid lines showing the roadway wheel assembly retracted to its storage position and the broken lines showing the roadway wheel assembly lowered to its extended position.

Near the back end of the wheel assembly 96, a pair of upstanding brackets 114 are provided at their upper ends with bearings 116. Truss arms 118 extend from the bearings 116 and have upper ends equipped with rollers 120 (one of which is shown in FIG. 4). The rollers 120 fit closely in tracks 122 which may take the form of slots in the inside faces of a pair of inclined arms 124. The back ends of the arms 124 connect with the top ends of vertical posts 126 which extend upwardly from the rear platform 16. The forward ends of arms 124 connect with the inclined rear beam sections 36 near their mid points.

A cab 127 for the car 10 is mounted on the rear platform 16 between posts 126. The cab 127 provides a station from which an operator can control the drive motors from the thread boxes 68, 76 and 88.

The truss arms 118 and the fit of the guide rollers 120 in the slots or tracks 122 provide support and guidance for the wheel assembly 96 as it is pivoted about the shaft 110 between the extended and retracted positions. In the extended position of the wheel assembly shown in FIG. 1, the wheels 102 are at a position below the flanged wheels 22 so that the flanged wheels 22 are raised above the roadway during over the road travel of the rail car 10. The towing vehicle 100 includes over the road wheels 128 which are located below the front flanged wheels 30 so that wheels 30 are raised above the roadway during over the road travel. The front platform 18 is provided with a suitable hitch 136 (FIG. 3) which allows the rail car 10 to be hitched to the towing vehicle 100 for over the road travel of the rail car.

In the retracted storage position of the wheel assembly 96, the wheels 102 are raised well above the track 24, thus allowing the flanged wheels 22 to engage the track 24 for travel of the rail car 10 along the track 24.

In operation, the special unloading rail car 10 is used for unloading of the ribbon rails from a series of connected rail cars such as the rail car 138 shown in FIG. 3. The rail car 138 may take the form of a flat bed car mounted on railway wheels 140 for travel on the track 24. The ribbon rails 12 may be supported in a plurality of discrete tiers on the car 138 and a number of identical cars connected end to end with the car 138 forwardly of it. Each of the tiers may include two of the ribbon ties 12 supported at transversely spaced locations on support structures commonly referred to as bunks 142. FIG. 3 shows five tiers of ribbon rails 12 each including two side-by-side ribbon rails, although the bunks can be constructed to accommodate different numbers of rails and tiers. A structure often referred to as a funnel 144 may be located at the back end of the rear car 138. The funnel 144 may be provided with doors which are normally closed to prevent rearward inadvertent sliding of the rails 12. When the rails are to be unloaded, the doors of the funnel 144 may be opened to allow the rails 12 to pass freely through the funnel to the rear.

The rail car 10 may be provided with a conventional coupling 146 (FIG. 3) allowing it to be coupled with the rear most rail carrying car 138.

In use, the rail car 10 may be moved along the track 24 to the area of the rail cars 138 by a locomotive with the wheel assembly 96 retracted as shown in FIG. 3. With the wheel assembly 96 retracted in its stored position, the flanged wheels 22 and 30 are able to travel along the track 24 so that the rail car 10 can be coupled to the rear most car 138 by the coupling 146.

It is a particular feature of the present invention that the rail car 10 can be towed over the road to the location of the cars 138 and then unloaded onto the track 24. The towing vehicle 100 may be hitched to the front end of the frame 14, with the wheels 128 assuring that the front flanged wheels 30 are raised above the roadway 98. The wheel assembly 96 is lowered to its extended operating position which is shown in FIG. 1. The actuator 112 is operated to pivot the arms 108 in a direction to extend the wheels 102 until they are all engaged with the roadway surface. The truss arms 118 and the guide arrangement provided by the rollers 120 and track 122 provide assistance in this regard. When the wheel assembly 96 has been lowered to its extended position, the rear wheels 22 are raised above the roadway surface so that the towing vehicle 100 can be used to tow the rail car 10 to the vicinity of the rail cars 138 on track 24. With the flanged wheels 22 and 30 aligned above the track, the actuator 112 can be energized to retract the wheel assembly 96 to its raised storage position, thus lowering the rear wheels 22 onto the track 24. The hitch 136 can be detached from the towing vehicle so that the rear wheels 30 are likewise lowered onto the track. The towing vehicle 100 can then be driven off, and the coupling 146 can be attached to couple the car 10 with the back end of the rear most rail carrying car 138.

To unload the ribbon rails 12 from the car 138, the doors of the funnel 144 are opened, and the gantry crane 40 is driven forwardly along beams 34 such that the jaws 66 can be applied to the back end portion of one of the lower ribbon rails 12. The jaws 66 may be closed to grasp the ribbon rail 12 and feed it to the rear through the funnel 144 and into the corresponding front thread box 68. Once the end portion of the rail 112 has been fed into the thread box 68, the thread box can be operated by a worker stationed in the cab. The motor 74 is operated to drive roller 72 and thus feed the rail 12 rearwardly toward the intermediate thread box 76 located behind the front thread box 68. The jaws 66 can be used to guide the rear end portion of the rail 12 into the intermediate thread box 76. The thread box 76 can then be operated to rotate the upper roller 86 and thus assist the forward box 68 in feeding the rail 12 to the rear and into the rear thread box 88 on the same side of the rail car. Again, the claw can be used to assist in guiding the rail toward the rear thread box 88. The gantry crane 40 can be moved to the rear to facilitate guiding operations and manipulation of the rails 12.

Once the end of the rail has been received in the rear thread box 88, it can be operated to rotate its drive roller 92 and thus assist the thread boxes 68 and 76 in feeding of the rail rearwardly and onto the railway bed beside the track 24. Because the rear thread boxes 88 are located outwardly from the flanged rear wheels 22, the rail 12 is positioned on the railway bed at a location outwardly of the corresponding rail for the track 24 which is already in place.

The thread boxes 68, 76 and 88 are operated to continue feeding of the ribbon rail 12 to the rear until the entire length of the rail has been unloaded from the rail car 138 and placed on the railway bed. While the first rail is being fed through the thread boxes, the second rail in the lower tier of rails on car 138 may be grasped by the jaws 66 and fed into the front thread box 68 on the opposite side of the rail car 10. This second of the two lower rails is unloaded by the three thread boxes 68, 76 and 88 in the same manner as described for the first rail. When the second rail has been unloaded, it is arranged beside the first rail and on the outside of the opposite rail of the track 24 so that the two rails are unloaded parallel to one another immediately outside of the track 24 that is in place on the railway bed.

The rails 12 in the second tier are then unloaded. One of these rails is first placed in the corresponding front thread box 68 by the gantry crane 40, and the other rail is then fed into the other front box 68. Once these rails have been fed through all three thread boxes 68, 76 and 88, the thread boxes all continue to operate as the train is driven forwardly at approximately the same speed as the thread boxes feed the rails rearwardly (typically about 1 mile per hour). This results in the rear end of each rail 12 in the second tier being located adjacent to the forward end of the previously unloaded rail in the first pair. Eventually, the rails in the second tier are unloaded by the thread boxes as the train travels forwardly such that the rails in the second tier are fully unloaded on the railway bed and arranged end to end with the first pair of rails.

The unloading process continues in the same manner tier by tier until all of the rails have been unloaded. In this manner, the rails 12 can be unloaded with minimal manual labor (only operators for the gantry crane 40 and cab 127 are required) and minimal risk of personal injury because of the absence of the need to handle the rails or other equipment. Further, considerable time and labor costs are conserved because there is no need to attach and detach the rails with tie bars or other connectors. At the same time, the rails are located end to end in a convenient arrangement for their installation.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A method of unloading elongated rails from a railcar traveling on track on a railway bed, said method comprising the steps of:

feeding a first rail on the railcar into a thread box having a power operated drive for transporting the rails through the thread box and onto the railway bed;

operating said drive of the thread box to transport said first rail through said thread box and onto the railway bed until said first rail is unloaded from the railcar onto the railway bed;

feeding a second rail on the railcar into said thread box, said second rail being disconnected from said first rail; and operating said drive of the thread box to transport said second rail therethrough while propelling said railcar away from the first rail along the track at a speed sufficient to maintain said second rail substantially end to end with said first rail, thereby unloading said second rail from the railcar onto the railway bed with the first and second rails positioned on the railway bed substantially end to end and disconnected from one another.

2. A method as set forth in claim 1, including the steps of:

feeding said first rail into a second thread box located generally in line with said first mentioned thread box, said second thread box having a power generated drive for transporting the rails through the second thread box;

operating said drive of the second thread box to transport said first rail through said second thread box and onto the railway bed;

feeding said second rail into said second thread box; and operating said drive of the second thread box to transport said second rail therethrough while said railcar is being propelled along the track.

3. A method as set forth in claim 2, including the steps of:

feeding said first rail into a third thread box located generally in line with said second mentioned thread box, said third thread box having a power generated drive for transporting the rails through the third thread box;

operating said drive of the third thread box to transport said first rail through said third thread box and onto the railway bed;

feeding said second rail into said third thread box; and operating said drive of the third thread box to transport said second rail therethrough while said railcar is being propelled along the track.

4. A method of unloading elongated rails from a railcar which travels on track on a railway bed, comprising the steps of:

feeding a first rail on the railcar into a first thread box having a power operated drive for transporting the rails through said first thread box and onto the railway bed;

feeding a second rail on the railcar into a second thread box located sidewardly from the first thread box and having a power operated drive for transporting the rails through said second thread box and onto the railway bed;

operating said drives of the first and second thread boxes to transport the respective first and second rails therethrough and onto the railway bed at locations spaced apart sidewardly until said first and second rails are unloaded from the railcar onto the railway bed;

feeding a third rail on the railcar into said first thread box;

feeding a fourth rail on the railcar into said second thread box;

operating said drives of the first and second thread boxes to transport the respective third and fourth rails therethrough while propelling said railcar away from the first and second rails along the track at a speed sufficient to maintain said third rail substantially end to end with said first rail and disconnected therefrom and said fourth rail substantially end to end with said second rail and disconnected therefrom, thereby unloading said third and fourth rails from the railcar onto the railway bed with the first and third rails disconnected and positioned on the railway bed substantially end to end and the second and fourth rails disconnected and positioned on the railway bed substantially end to end.

* * * * *